US009500004B2

(12) United States Patent
Lin

(10) Patent No.: US 9,500,004 B2
(45) Date of Patent: Nov. 22, 2016

(54) VEHICLE DOOR UNLOCKING DEVICE

(71) Applicant: Kun-Meng Lin, Changhua County (TW)

(72) Inventor: Kun-Meng Lin, Changhua County (TW)

( * ) Notice: Subject to any disclaimer, the term of this patent is extended or adjusted under 35 U.S.C. 154(b) by 243 days.

(21) Appl. No.: 14/228,278

(22) Filed: Mar. 28, 2014

(65) Prior Publication Data

US 2015/0275549 A1 Oct. 1, 2015

(51) Int. Cl.
*E05B 19/20* (2006.01)

(52) U.S. Cl.
CPC ..... *E05B 19/20* (2013.01)

(58) Field of Classification Search
CPC ..... E05B 19/20
USPC ..... 81/15.9
See application file for complete search history.

(56) References Cited

U.S. PATENT DOCUMENTS 3,004,362 A * 10/1961 Day ..... A01K 77/00 16/422
5,237,890 A * 8/1993 Gill ..... B66F 13/00 24/615
5,593,196 A * 1/1997 Baum ..... B25J 1/04 294/174
6,070,491 A * 6/2000 Claudio ..... G05G 1/08 403/104
6,591,473 B1 7/2003 Child
7,281,450 B1 * 10/2007 Weinraub ..... E05B 19/20 81/15.9
D714,613 S * 10/2014 Jenkins ..... D8/107
9,003,928 B2 * 4/2015 Vigil ..... E05B 19/20 81/15.9

* cited by examiner

*Primary Examiner* — Hadi Shakeri

(57) ABSTRACT

A vehicle unlocking device includes a first rod, a second rod, a first connecting member, a second connecting member, and a lock device. Therein, the first rod has one end as a handle and the other end as a first fixing part. The second rod has one end as a bended hook part and the other end as a second fixing part. The first connecting member is fixed to the first fixing part. The second connecting member is fixed to the second fixing part and sleeves the first connecting member, while the first and second connecting members are kept from rotating against each other. The lock device is in between the first and second connecting members for manipulating the axial detachment of the second connecting member from the first connecting member.

10 Claims, 7 Drawing Sheets

VEHICLE DOOR UNLOCKING DEVICE

BACKGROUND OF THE INVENTION

1. Field of the Invention

The present invention relates to unlocking devices, and more particularly, to a vehicle door unlocking device.

2. Description of the Related Art

U.S. Pat. No. 6,591,473 discloses a method of releasing a locked door on an automotive vehicle when the key is unavailable, which is accomplished by use of a wedge W and a rod-like probe P. The wedge W is used for inserting into the gap between the ear door and the door frame, thereby prying out a portion of the perimeter of the door sufficiently for the probe P to be inserted for manipulating the locking mechanism of the car and thus opening the car door. However, the probe P comprises a handle H and a tip PT, while the probe P possesses a certain degree of rigidity and length for successfully unlocking the car door. Based on the fact that the actual length of the probe P is 56 inches, cost of packaging and transporting is easily increased. In addition, the probe P is inconvenient of being stored.

Also, U.S. Pat. No. 7,281,450 discloses another unlocking tool for vehicle doors, comprising, as shown by FIG. 4 and FIG. 4*a* thereof, a first rod section 42 and a second rod section 50 screwed to the first rod section 42. Such an unlocking tool combined by two components decreases the inconvenience of being stored and lowers the cost for packaging and transporting. However, the end parts of the first rod section 42 and the second rod section 50 need to he provided with a female threaded hole 48 and a corresponding threaded male end portion 56, respectively. Due to the over length structure, the components are difficult to be clamped during the processing, causing the inconvenience of manufacturing. Furthermore, when the force is transmitted from the first rod section 42 to the second rod section 50 during the operation, if the first rod section 42 is reversely driven, the second rod section 50 tends to rotate against the first rod section and be loosened from the first rod section 42. As a result, the second rod section 50 parts from the first rod section 42, causing the inconvenience of usage.

SUMMARY OF THE INVENTION

For improving aforementioned difficulties, the present invention discloses a vehicle unlocking device provided with a first rod and a second rod removably combined with the first rod. When being combined, the first rod and the second rod are prevented from rotating against each other, whereby loosening of the two rods are prevented during the operation of the present invention.

Thus, the present invention provides a vehicle unlocking device, comprising;

a first rod, with one end thereof as a handle and the other end thereof as a first fixing part;

a second rod, with one end thereof as a bended hook part and the other end thereof as a second fixing part;

a first connecting member fixed to the first fixing part;

a second connecting member fixed to the second fixing part and sleeving the first connecting member, while the first and second connecting members are kept from rotating against each other; and a lock device, disposed between the first connecting member and the second connecting member for manipulating the axial detachment of the second connecting member from the first connecting member.

Therefore, during the operation of the present invention, the first and second connecting members are prevented from rotating against each other, whereby the force imposed on the first rod is transmitted to the second rod effectively, facilitating the unlocking process.

Furthermore, the first and second connecting members are manufactured, respectively, and allowed to be coupled by use of convex and concave structures. Based on the fact that such structures are not manufactured integrally on elongate first and second rods, the manufacturing process of the present invention is easier and simpler. The general cost of manufacturing is lowered, and the assembling of the present invention is time saving.

DETAILED DESCRIPTION OF THE INVENTION

Figure 1:
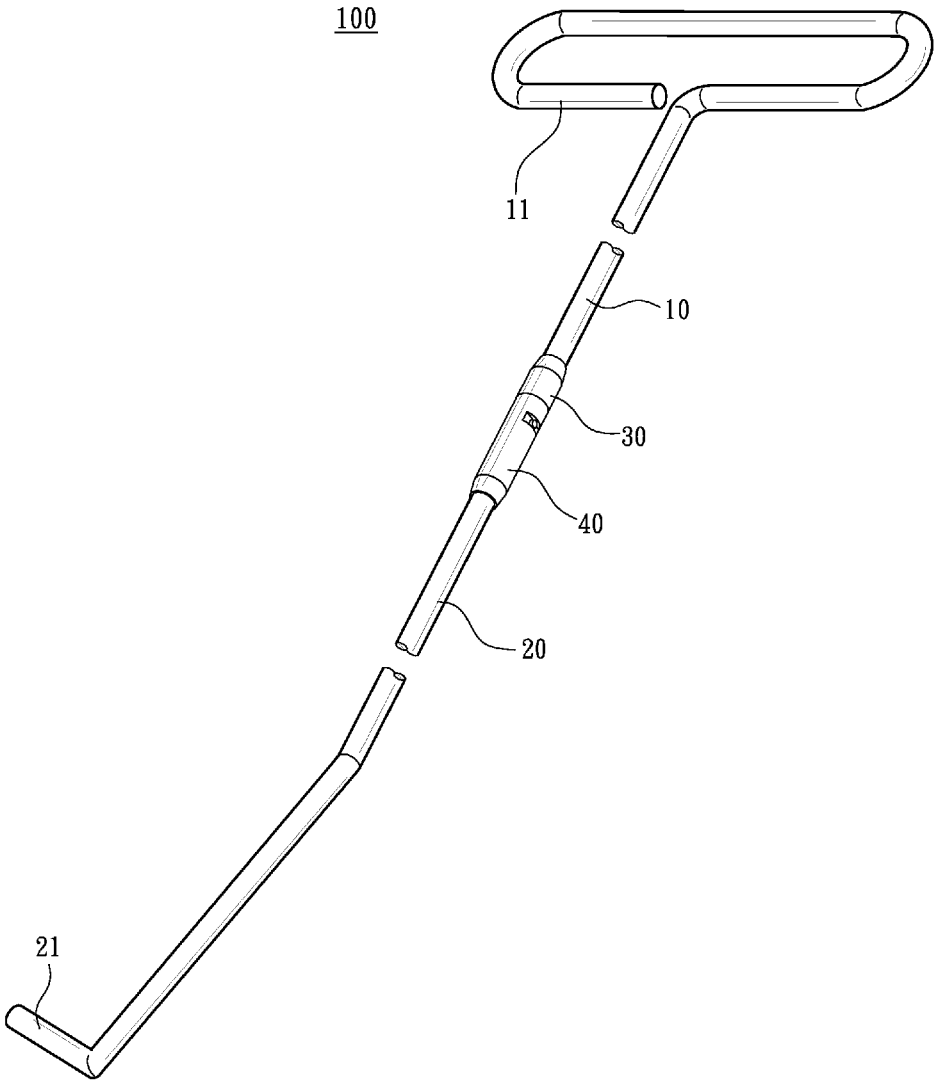
FIG. 1 is a perspective view of the vehicle unlocking device in accordance with the present invention.
Figure 2:
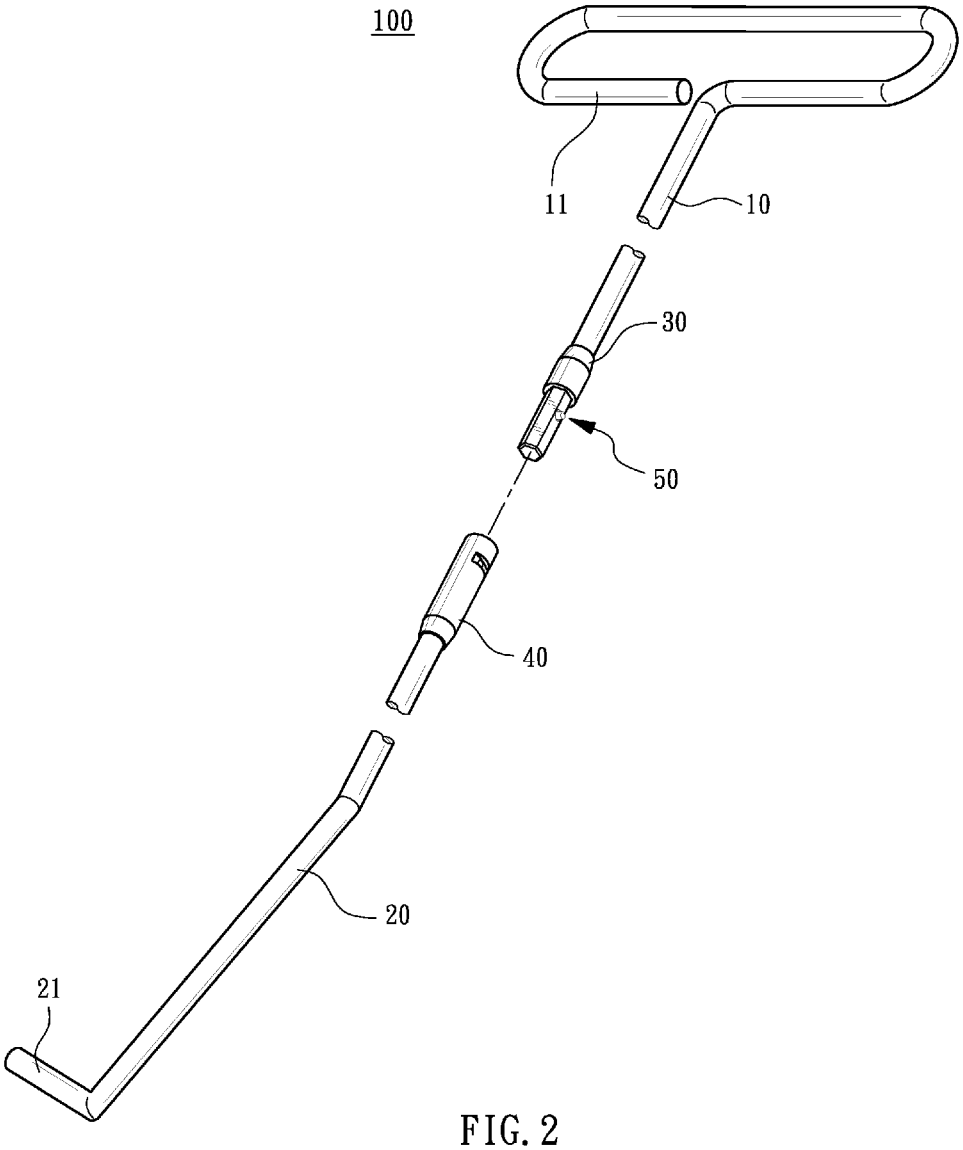
FIG. 2 is an exploded view of the vehicle unlocking device in accordance with the present invention.

The aforementioned and further advantages and features of the present invention will be understood by reference to the description of the preferred embodiment in conjunction with the accompanying drawings where the components are illustrated based on a proportion for explanation but not subject to the actual component proportion.

Referring to FIG. 1 to FIG. 4, the vehicle unlocking device 100 provided by the present invention, which is used to probe into the vehicle for opening the vehicle door when the key of the vehicle is unavailable, comprises a first rod 10, a second rod 20, a first connecting member 30, a second connecting member 40, and a lock device 50.

The first rod 10 is present as an elongate shape and possesses a certain degree of rigidity, with one end thereof as a handle 11 and the other end thereof as a first fixing part 12, while the first fixing part 12 is provided with a first fixing hole 121.

The second rod 20 is present as an elongate shape and possesses a certain degree of rigidity, with one end there of as a bended hook part 21 and the other end as a second fixing part 22, while the second fixing part is provided with a second fixing hole 221.

The first connecting member 30 is provided with a coupling part 31 present, as a hexagonal column on one end, and a coupling recess 32 on the other end, while a first pin hole 33 is disposed on a lateral side of the first connecting member 30 for connecting the coup ling recess 32. The coupling recess 32 receives the first fixing part 12 of the first rod 10, and a first positioning pin 34 is inserted into the first pin hole 33 and the first fixing hole 121 simultaneously for combining the first rod 10 and the first connecting member 30.

The second connecting member 40 is provided with a socket 41 penetrating both ends thereof, while one end of the inner periphery of the socket 41 is present as a hexagonal portion and the other end of inner periphery the socket 41 is present as a circular portion. One lateral side of the second connecting member 40 is provided with a second pin hole 42 for connecting the circular portion of the socket 41. The hexagonal portion of the socket 41 sleeves the coupling part 31, whereby the second connecting member 40 is prevented from rotating against the first connecting member 30, The circular portion of the socket 41 receives the second fixing part 22 of the second rod 20, while a second positioning pin 43 is inserted into the second pin hole 42 and the second fixing hole 221 simultaneously for combining the second rod 20 and the second connecting member 40.

Therein, the end of the first connecting member 30 away from the second connecting member 40 is provided with a first taper part 35, and the end of the second connecting member 40 away from the first connecting member 30 is provided with a second taper part 44, while the first and second taper parts 35, 44 are disposed toward opposite directions, and the peripheral surfaces of the first and second taper parts 35, 44 flush with each other when being combined together. Therefore, the second taper part 44 and the first taper part 35 enable the unlocking device 100 to flexibly and fluently be probed into the vehicle door with lower possibility of scratching the vehicle paint or damaging the door trim of the vehicle door.

The lock device 50 is disposed between the first connecting member 30 and the second connecting member 40 for manipulating the axial detachment of the second connecting member 40 from the first connecting member 30, Therein, the lock device 50 comprises a containing hole 311 radially disposed on the coupling part 31 of the first connecting member 30, a latch member 51 movably disposed in the containing hole 311, a spring 52 disposed in the containing hole 311 for pushing the latch member 51, and a fastening hole 45 disposed on the periphery of the second connecting member 40 and connecting the hexagonal portion of the socket 41. The latch member 51 is provided with a latch base 511 for being pushed outward from the containing hole 311 by the spring 52, and a circular-column shaped latch button 512 extends from the latch base 511, wherein the diameter of the latch button 512 is smaller than the diameter of the latch base 511. When the spring 52 and the latch member 51 are orderly disposed hi the containing hole 331, an anti-detachment measure is applied to deform the opening of the containing hole 311, thereby preventing the latch member 51 from detaching from the containing hole 311.

Figure 4:
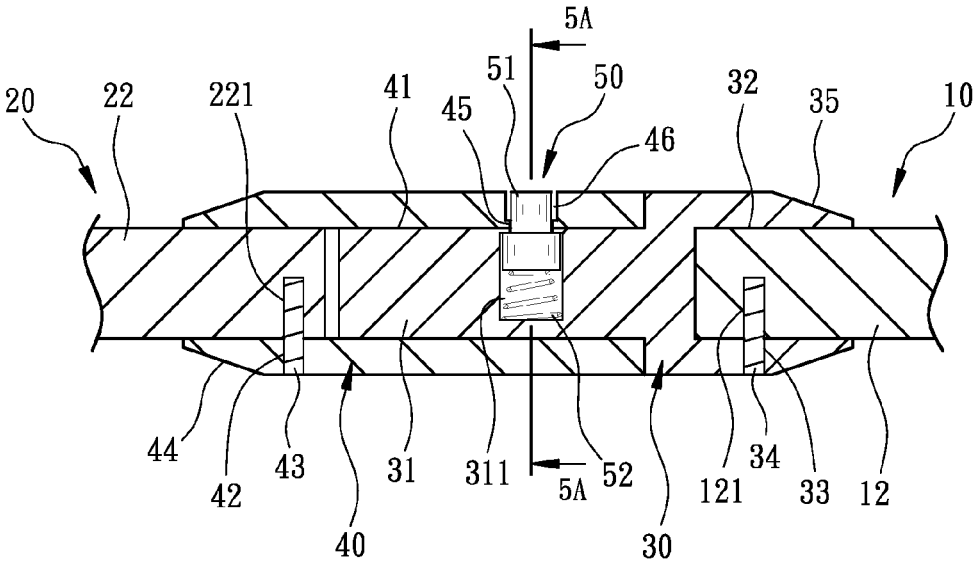
FIG. 4 is a schematic view illustrating the connected status of the first connecting member and the second connecting member.
Figure 5A:
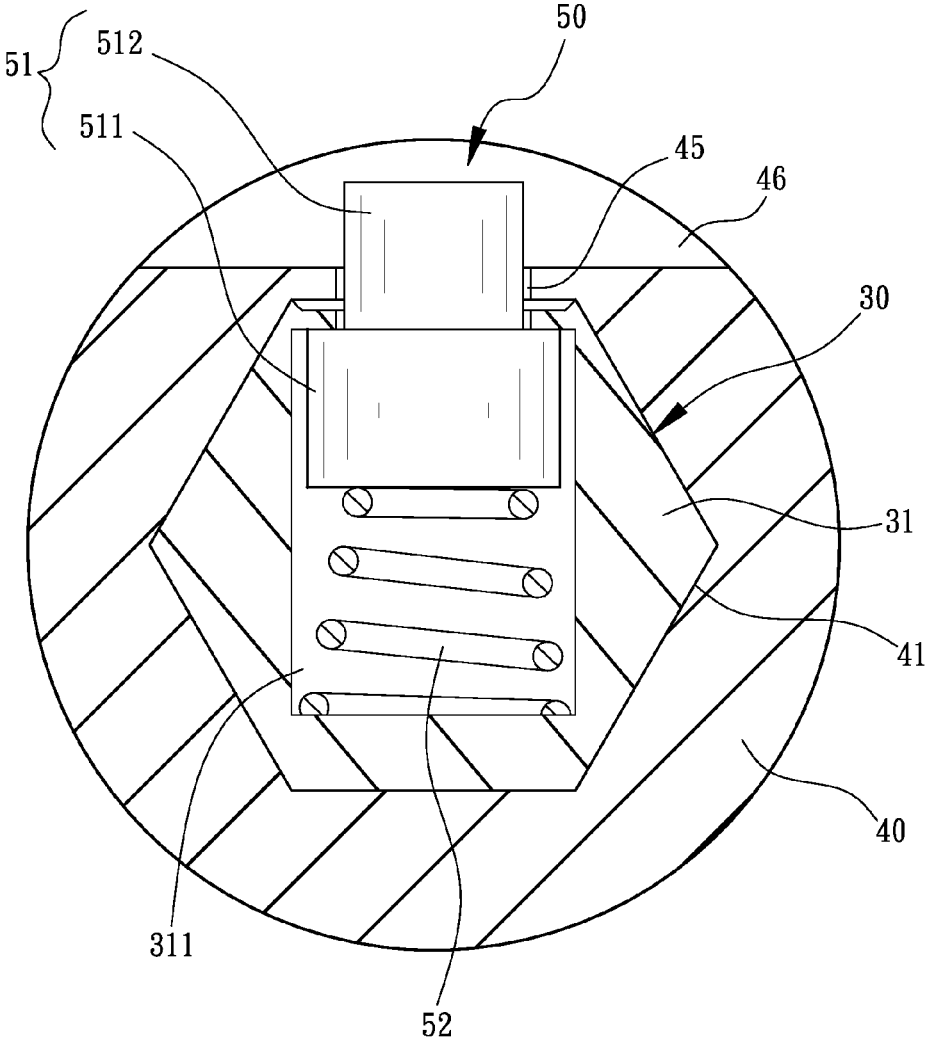
FIG. 5A is a cross-sectional view taken along line 5A-5A in accordance with FIG. 4, showing the latch member in the locked position.
Figure 5B:
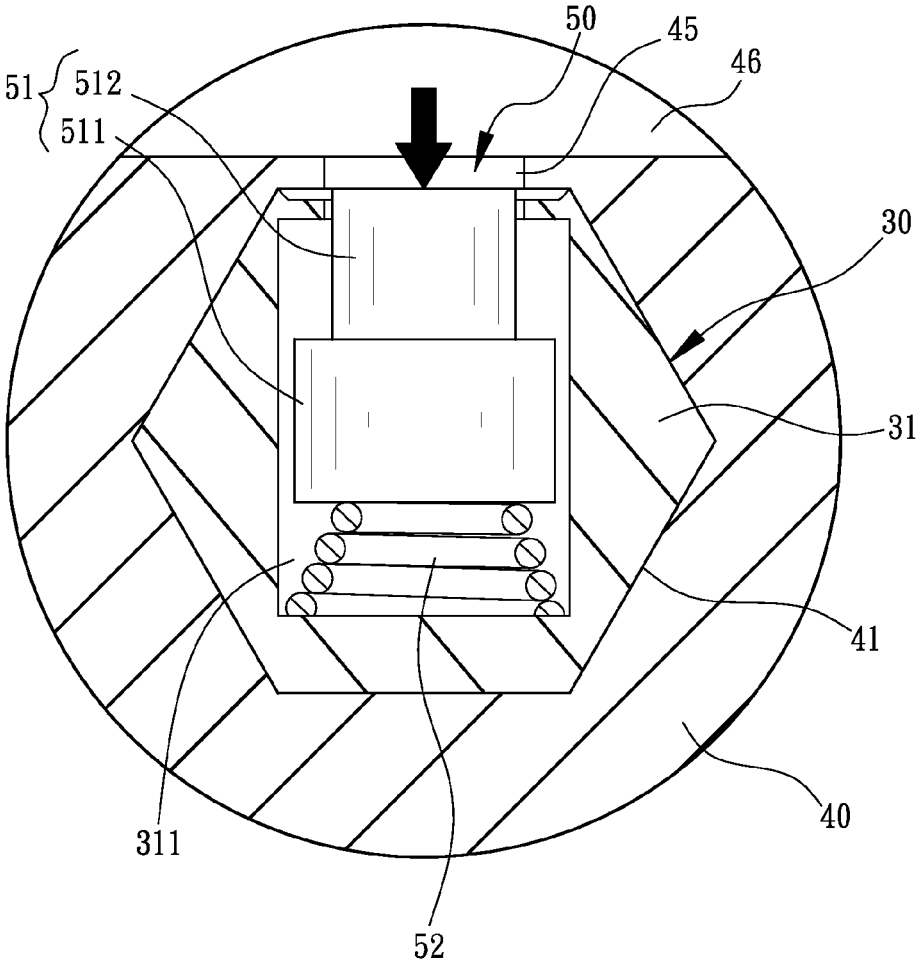
FIG. 5B is another cross-sectional view taken along line 5A-5A. in accordance with FIG. 4, showing the latch member in the unlocked position.
Figure 6:
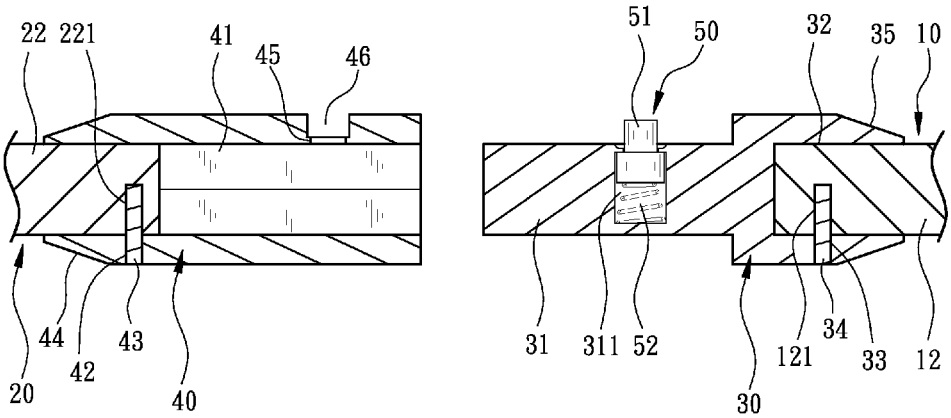
FIG. 6 is a schematic view illustrating the separated status of the first connecting member and the second connecting member.

The latch member 51 is allowed to move between a locked position and an unlocked position, as shown by FIG. 4 and FIG. 5A. When in the locked position, the latch member 51 is pushed outward by the spring 52, whereby the latch button 512 of the latch member 51 is inserted through the fastening hole 45, thus keeping the first connecting member 30 and the second connecting member 40 from separating with each other, accomplishing a connected status, and thereby enabling the unlocking device 100 to unlock the vehicle door. As shown by FIG. 5B and FIG. 6, when the latch button 512 of the latch member 51 is imposed with an external force, the latch button 512 forces the spring 52 to contract, whereby the latch button 512 is released from the fastening hole 45, and the latch member 51 thus moves to the unlocked position. As a result, the first connecting member 30 is allowed to detach from the second connecting member 40, accomplishing a separated status. Therefore, the unlocking device 100 of the present invention is easily packaged, transported, and stored.

Figure 3:
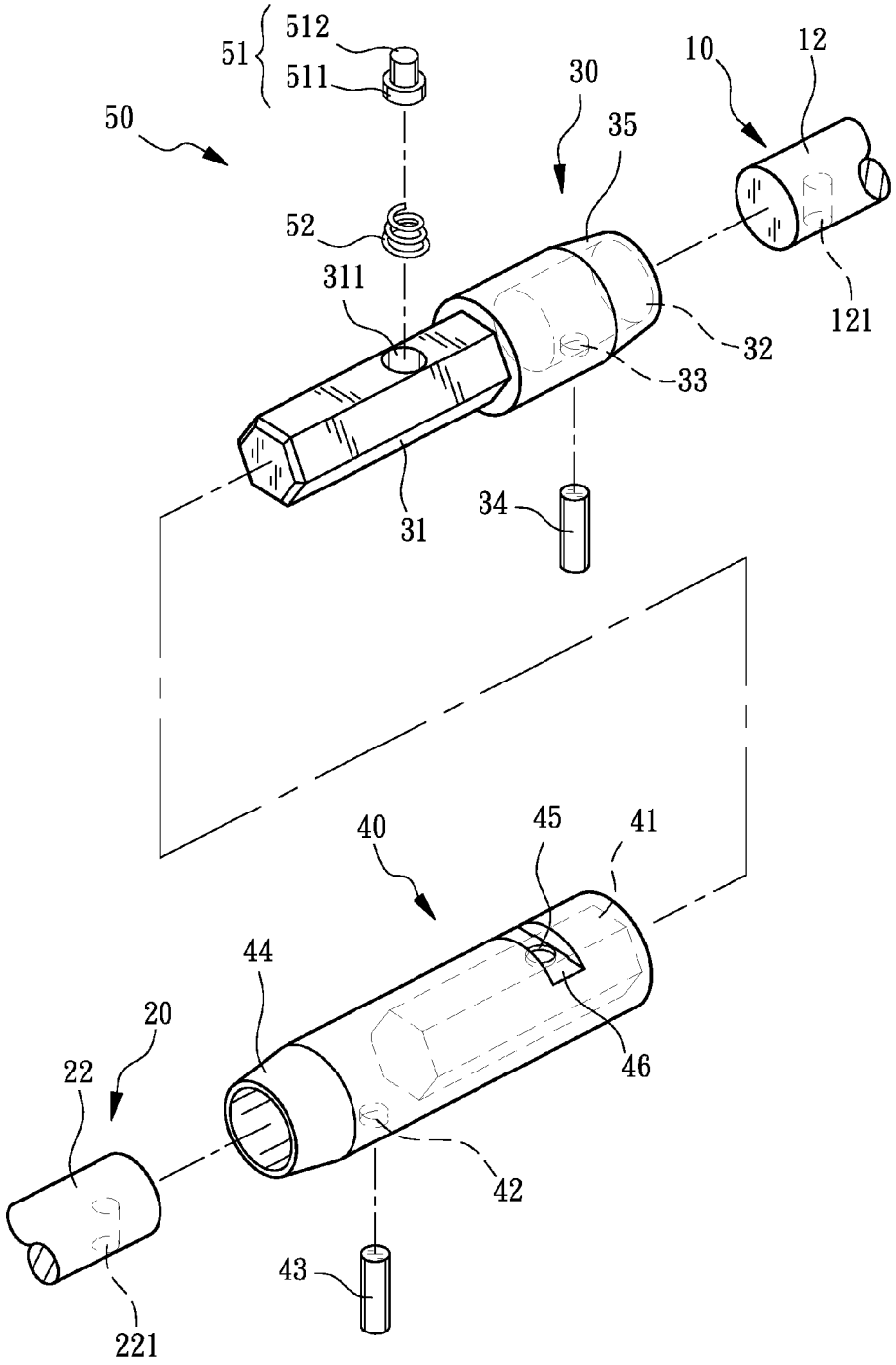
FIG. 3 is a partially enlarged view of the vehicle unlocking device in accordance with the present invention.

Therein, when the latch member 51 is in the locked position, the latch but too 512 of the latch member 51 is prevented from exposing on the outer periphery of the second connecting member 40, whereby the outer periphery of the second connecting member 40 remains flat, preventing the unlocking device 100 of the present invention from damaging the vehicle door or the inner equipment thereof Also, the latch button 512 of the latch member 51 is present as a circular column, with the top end thereof as a flat surface, whereby the comfortableness is offered to the finger of the user when the present invention is being operated. Furthermore, to facilitate the pressing of the latch member 51, a groove 46 is transversely disposed on the second connecting member 40, while the fastening hole 45 is disposed in the groove 46, as shown by FIG. 3.

Referring to FIG. 4, the coupling part 31 of the first connecting member 30 is present as a hexagonal column, while the socket 41 of the second connecting member 40 is present as a corresponding hexagonal shape. As a result, when the coupling part 31 and the socket 41 are combined, the rotation of the coupling part 31 against the socket 41 is prevented, thus facilitating the usage of the present invention. Therefore, when the present invention is driven either in clockwise or counterclockwise direction, the components of the unlocking device 100 are kept from loosening against each other, and the ineffective transmission of the force and the accidental detachment of components are thus avoided. In addition, the corresponding shapes of the coupling part 31 and the socket 41 of the present invention are allowed to be chosen from other non-circular shapes, such as triangular or rectangular shape.

To sum up, the first and second rods 10, 20 are combined to the first and second connecting members 30, 40 through the first and second positioning pins 34, 43, respectively, while the connection between the first rod 10 and the second rod 20 is accomplished by the first connecting member 30 combined and the second connecting member 40 applying convex and concave structures. Since the connecting structures do not have to be integrally manufactured on the first and second rods 10, 20, the assembling of the present invention is time-saving, and the cost of manufacturing is lowered.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A vehicle unlocking device, comprising:

a first rod, with one end thereof as a handle and the other end thereof as a first fixing part;

a second rod, with one end thereof as a bended hook part and the other end thereof as a second fixing part;

a first connecting member fixed to the first fixing part and provided with a coupling cart on one end thereof, the coupling part radially provided with a containing hole;

a second connecting member fixed to the second fixing part and provided with a socket, an inner periphery of the socket provided with a hexagonal portion, the coupling part formed in a hexagonal column, the socket sleeving the coupling part, such that the socket and the coupling parts are prevented from rotating against each other, wherein the second connecting member is radially provided with a fastening hole and the fastening hole is disposed on a periphery of the second connecting member and connected with the socket; further, a groove is transversely and concavely disposed on the second connecting member in where the fastening hole is disposed; and a lock device, comprising a latch member which is radially disposed on the first connecting member and movable between a locked position and an unlocked position; when at the locked position, the latch member passes through the fastening hole, whereby the first connecting member is unable to be separated from the second connecting member, and the latch member protrudes from the groove and is prevented from protruding on an outer periphery of the second connecting member; when at the unlocked position, the latch member is separated from the fastening hole, whereby the first connecting member is separated from the second connecting member.

2. The vehicle unlocking device of claim 1, wherein the other end of the first connecting member is provided with a coupling recess for receiving the first fixing part.

3. The vehicle unlocking device of claim 1, wherein a spring is disposed in the containing hole for pushing the latch member.

4. The vehicle unlocking device of claim 3, wherein the latch member is provided with a latch base for being pushed by the spring, and a latch button of a circular column shape extends from the latch base.

5. The vehicle unlocking device of claim 1, wherein the first fixing part of the first rod is combined to the first connecting member by a first positioning pin.

6. The vehicle unlocking device of claim 5, wherein the first fixing part is provided with a first fixing hole, and the first connecting member is provided with a first pin hole for receiving the first positioning pin.

7. The vehicle unlocking device of claim 1, wherein the second fixing part of the second rod is combined to the second connecting member by a second positioning pin.

8. The vehicle unlocking device of claim 7, wherein the second fixing part is provided with a second fixing hole, and the second connecting member is provided with a second pin hole for receiving the second positioning pin.

9. The vehicle unlocking device of claim 1, wherein one end of the first connecting member away from the second connecting member is provided with a first taper part.

10. The vehicle unlocking device of claim 1, wherein one end of the second connecting member away from the first connecting member is provided with a second taper part.

* * * * *